US009468264B2

(12) United States Patent
Meythaler

(10) Patent No.: US 9,468,264 B2
(45) Date of Patent: Oct. 18, 2016

(54) FLEXIBLE STUD

(75) Inventor: Dirk Meythaler, Nürnberg (DE)

(73) Assignee: adidas AG, Herzogenaurach (DE)

( * ) Notice: Subject to any disclaimer, the term of this patent is extended or adjusted under 35 U.S.C. 154(b) by 466 days.

(21) Appl. No.: 13/222,546

(22) Filed: Aug. 31, 2011

(65) Prior Publication Data

US 2012/0066933 A1 Mar. 22, 2012

(30) Foreign Application Priority Data

Sep. 17, 2010 (DE) ..... 10 2010 040 964

(51) Int. Cl.
*A43C 15/16* (2006.01)
*A43B 5/02* (2006.01)
*A43B 13/14* (2006.01)

(52) U.S. Cl.
CPC ..... *A43C 15/168* (2013.01); *A43B 5/02* (2013.01); *A43B 13/141* (2013.01); *A43C 15/16* (2013.01); *A43C 15/162* (2013.01)

(58) Field of Classification Search
CPC ..... A43C 15/00; A43C 15/02; A43C 15/04; A43C 15/16; A43C 15/161; A43C 15/168; A43B 5/02
USPC ..... 36/59 R, 67 R, 67 A, 126, 128
See application file for complete search history.

(56) References Cited

U.S. PATENT DOCUMENTS 3,593,436 A 7/1971 Vietas
4,283,865 A * 8/1981 Dassler ..... 36/32 R
5,377,431 A 1/1995 Walker et al.
5,384,973 A 1/1995 Lyden
5,505,012 A 4/1996 Walker et al.
5,617,653 A 4/1997 Walker et al.
5,819,322 A 10/1998 Dicker et al.
5,901,472 A 5/1999 Adam
5,960,474 A 10/1999 Dicker et al.
6,817,117 B1 * 11/2004 Campbell ..... 36/127
7,409,783 B2 * 8/2008 Chang ..... 36/59 R
8,056,267 B2 * 11/2011 Auger et al. ..... 36/114
8,356,428 B2 * 1/2013 Auger et al. ..... 36/102
8,453,349 B2 * 6/2013 Auger et al. ..... 36/59 R
8,453,354 B2 * 6/2013 Baker ..... 36/134

(Continued)

FOREIGN PATENT DOCUMENTS

CH 626517 11/1981
DE 2313646 10/1974

(Continued)

OTHER PUBLICATIONS

Japanese Patent Application No. 2011-188669, Office Action mailed Oct. 28, 2014, 7 pp. (English translation provided).

(Continued)

*Primary Examiner* — Khoa Huynh
*Assistant Examiner* — Sharon M Prange
(74) *Attorney, Agent, or Firm* — Kilpatrick Townsend & Stockton LLP

(57) ABSTRACT

Described are studs for a shoe sole comprising at least a first stud portion and a second stud portion and at least one first strain section, which connects the first stud portion and the second stud portion to each other, wherein the at least one first strain section is configured to be strained when the stud is coupled to the shoe sole and the shoe sole is bent.

19 Claims, 8 Drawing Sheets

(56) References Cited

U.S. PATENT DOCUMENTS

| | | | | |
|---|---|---|---|---|
| 8,522,457 | B2 * | 9/2013 | Scholz et al. | 36/102 |
| 2007/0107262 | A1 | 5/2007 | Chang | |
| 2007/0199211 | A1 | 8/2007 | Campbell | |
| 2009/0293315 | A1 | 12/2009 | Auger et al. | |
| 2010/0154258 | A1 * | 6/2010 | Scholz et al. | 36/30 R |

FOREIGN PATENT DOCUMENTS

| | | |
|---|---|---|
| DE | 3433337 | 3/1986 |
| DE | 4123302 | 1/1993 |
| DE | 19652462 | 6/1998 |
| DE | 29807086 | 7/1998 |
| EP | 0356637 | 3/1990 |
| EP | 1857006 | 11/2007 |
| EP | 2361521 | 8/2011 |
| GB | 2425706 | 11/2006 |
| WO | 8706437 | 11/1987 |
| WO | 03/071893 | 9/2003 |
| WO | 2008/152502 | 12/2008 |
| WO | 2010/012047 | 2/2010 |

OTHER PUBLICATIONS

European Patent Application No. 11181020.6, "Extended European Search Report" mailed Dec. 20, 2011, 6 pages.

* cited by examiner

FLEXIBLE STUD

CROSS REFERENCE TO RELATED APPLICATIONS

This application is related to and claims priority benefits from German Patent Application Serial No. 10 2010 040 964, filed on Sep. 17, 2010, the entire disclosure of which is hereby incorporated by this reference.

FIELD OF THE INVENTION

The field of the invention relates to a stud for a studded shoe, a shoe sole and a studded shoe.

BACKGROUND

Studs and studded shoes, such as shoes used in football, are commonly used to provide a good grip and traction on soft ground, such as turf. For example, studded shoes comprise studs which can penetrate the ground and prevent the studded shoe from sliding above the ground.

In football and other sports, the soil conditions of the respective playing fields may vary. This variation may be due to external influences, such as rain, whereby the ground is softened. On the other hand, the ground may be very dry and hard. Variations in surface conditions may also be present across different sections of a field. These variations may include small bumps or even larger depressions.

Therefore different types of studs and studded shoes have been developed. The studs typically have a rotationally-symmetric shape but may also have different shapes, such as a triangular or elongated shape. The stud shape allows for quick changes of speed or direction, as typically occurs in football and many other sports.

In the past, studs or studded shoes have been developed in order to provide an improved power transmission or to provide an ability to adapt to different ground conditions. For example, International Publication No. WO 03/071893 discloses a studded shoe in which several studs are connected via springs. For example, FIG. 3*a* shows that a larger stud may penetrate soft ground and no force is transmitted via the springs to other studs connected with the first stud. On the other hand, FIG. 3*b* shows that on hard ground the stud is pushed into the direction of the sole, so that the springs transmit a force to the smaller studs, which are then pushed away in order to improve the grip with the ground.

Great Britain Publication No. 2425706 A discloses a football shoe comprising a sole with studs, which may move independently from each other in the forefoot area of the sole. In this example, the studs are attached to segmented elements. See FIG. 3. The segmented elements are attached to an elastic layer of the sole which may stretch under pressure, thus allowing the studs to move. Similarly, U.S. Pat. No. 5,384,973 discloses a sole with spikes wherein single segments of the sole are separated, allowing for an independent movement of the segments. See FIG. 27.

U.S. Pat. No. 3,593,436 discloses a sole for a sports shoe, which is manufactured from a single piece of an elastic material. The sole comprises a plurality of studs that extend downwards from the sole. The disclosed shoe is useful for providing a good grip on synthetic turf, which does not damage the turf.

German Patent No. 298 07 086 U1 relates to a stud that comprises a movable core. In this example, the movable core is built into the stud and may be pushed outwards via a spring. Thus, depending on the properties of the ground, the stud may enter the ground.

European Patent No. 1 857 006 A1 relates to situations where the force exerted onto individual studs leads to deformation of the sole, which may be uncomfortable to the athlete wearing the shoe. The discomfort experienced by the athlete may be reduced by grouping several studs, which avoids movement of a single stud. The problem of cushioning forces in axial direction is also addressed in German Patent No. 41 23 302, which teaches the use of a cushioning hook element to increase the comfort of the athlete.

German Patent No. 2 313 646 also addresses this problem via use of a stud having a holding element and a supporting element. An intermediate element is attached between these elements, which supports elastic movement of the supporting element in the supporting direction.

European Patent No. 0 356 637 B1 is also directed to improving the cushioning of sports shoes having a sole with studs. In this example, angular bodies are attached to the studs, which may lead to deformation and, thus, cushioning under non-axial forces.

U.S. Pat. No. 5,505,012 discloses the use of so-called bumpers, which are used to attach the studs to the sole as a way of reducing the force between the sole and the studs.

German Patent No. 196 52 462 A1 relates to a sole with different zones of rigidity, which may improve rolling-off of the foot.

U.S. Pat. No. 5,617,653 relates to attaching studs to sports shoes. In this example, when a certain force is exceeded, the studs may be released from the shoe in order to prevent injuries.

German Patent No. 34 33 337 A1 is directed to a system of two studs, which serve to improve the wearing comfort.

The prior art, however, does not provide a solution that provides both improved traction and flexibility. For example, the attachment of studs to the sole leads to an increased rigidity of the sole in the area of the attachment, which is especially true for studs that are not rotationally-symmetric. Such studs may be better suited than rotationally-symmetric studs for quick changes of direction, but asymmetric studs generally have a larger attachment area that considerably increases the rigidity of the sole in that area. As a result, in many cases, studs are not attached to the shoe in the bending area of the shoe The absence of studs in the bending area increases flexibility and improved wearing comfort, but reduces grip.

In other cases, studs are attached to the bending area for an improved grip, which in turn reduces flexibility. This configuration reduces wearing comfort and may also lead to reduced traction since the foot cannot be rolled-off optimally. Hence, known studded shoes are generally built to provide good traction, which results in reduced flexibility of the shoe in the bending area. As a result, movements such as acceleration as required in sports such as football become more difficult for an athlete.

The technical problem underlying the present invention is therefore to provide a stud, a shoe sole, and a studded shoe that at least partially overcomes the disadvantages of the prior art so that good traction and improved flexibility of the sole are possible.

SUMMARY

Embodiments of the present invention include a stud for a shoe sole comprising at least a first stud portion and a second stud portion, and at least one first strain section, which connects the first stud portion and the second stud portion to each other, wherein the at least one first strain section is configured to be strained when the stud is coupled to the shoe sole and the shoe sole is bent.

Contrary to the prior art, the construction of such a stud provides a shoe sole with one or more studs also in the bending area of the shoe sole, e.g., in the area of the forefoot between the ball of the foot and the phalanges. This design allows for an improved traction and, thus, power transmission between foot and ground. The at least one first strain section enables the stud to adapt at least partially to the bending of the shoe sole in a dorsal direction. Thus, the comfort of the athlete is not reduced even under great forces. In particular, rolling off of the foot causes bending of the shoe sole. Thereby, outer portions of the stud are bent more significantly than inner portions. The inclusion of the at least one first strain section allows for such a strain because, without the at least one first strain section, the stud is rigid, which contributed to the problems of the prior art. In particular, the athlete may use his force more efficiently, since this advantageous approach allows for placing studs in the bending area of the foot, which consequently leads to better adaptation to ground conditions and improved transmission of force. Embodiments of the present invention are suitable for all shapes of studs, especially for elongated or asymmetric shapes. Suitable studs therefore include components that are optimised for different tasks. While portions of the stud offer the required grip with the ground and therefore may be made of a rigid material, the connecting strain section alleviates rolling off of the foot by enabling a strain of the stud, which can adapt to the bending of the shoe sole. According to certain embodiments, the strain section may also penetrate the ground.

In certain embodiments, the first stud portion and the second stud portion are connected to each other only by the at least one first strain section. These embodiments allow for maximized strain flexibility, since there are no non-elastic areas between the portions that could prevent a strain. Moreover, the portions are connected to each other at least indirectly via a stud attachment device and/or the shoe sole. However, these indirect connections have no influence on strain of the stud when the shoe sole bends.

In other embodiments, the first stud portion and the second stud portion are additionally connected to each other through a material ridge. Connecting the first stud portion and the second stud portion reduces the bending flexibility, but also allows for a more stable construction of the stud. For certain types of studs, positions of studs, or certain purposes, having a more stable construction may be more important than providing maximum bending flexibility. For example, a more rigid stud at the tip and/or the heel of a shoe sole may be advantageous. Moreover, the material ridge allows for an easier production, since the stud can be built integrally and can be made from fewer components. Further, depending on the use case, it is possible to reduce the strain or to create a dead stop.

In other embodiments, the first stud portion, the second stud portion, and the at least one first strain section are integrally formed. The first stud portion and the second stud portion may be assembled in a single step. Such an assembly advantageously reduces the required number of components.

In certain embodiments, the at least one first strain section comprises an angle of 45 degrees to 90 degrees with a surface of the shoe sole. Arranging the at least one first strain section at a certain angle allows for adapting to specific conditions, e.g., certain studs may experience specific loads which require an inclination of the strain section in order to fully exploit the advantageous properties of the particular stud.

According to certain embodiments, the at least one first strain section extends substantially perpendicular to a tangent plane proximate an area of the shoe sole where the stud is configured to be coupled to the shoe sole. This configuration allows for a bending of the stud—and thus of the shoe sole—if the foot is bent in dorsal direction. As a result, this configuration allows for an easier rolling-off of the foot, since the shoe sole is more flexible, without waiving the improved traction of additional studs in the bending area of the shoe sole. Different orientations of the strain section are also possible. The at least one first strain section may be optimized with respect to the bending properties of the respective shoe sole. For example, certain sports may require bending the shoe sole in a lateral direction and, thus, may require one or more studs in that area. In this case, the at least one first strain section may be such that a lateral rolling-off of the foot is hindered as little as possible.

In certain embodiments, the at least one first strain section has substantially a shape of a strip. This kind of strain section is easy to build and assemble with other parts of the stud.

In other embodiments, the at least one first strain section is wedge-shaped. The wedge shape allows for an improved alignment of the stud when rolling-off of the foot. Preferably, in a lateral view, the wedge is arranged such that the wider end points towards the ground, since the outer portions of the strain section experience a greater strain than the inner portions, i.e., the portions nearer to the shoe sole. This enables a particularly good adaptation of the stud, and the strain section is not overstressed. Moreover, other shapes of strain sections are possible, depending on the respective use case.

In certain embodiments, the stud further comprises a second strain section and a third stud portion, wherein the second strain section connects the second stud portion and the third stud portion to each other, and the second strain section is configured to be strained when the stud is coupled to the shoe sole and the shoe sole is bent. By adding another strain section, additional adaptations to the bending of the shoe sole are possible. In these embodiments, an improved bending of the shoe sole, even in the bending area of the shoe sole, can be achieved. Adding further strain sections and portions to the stud may also be desirable.

In other embodiments, the at least one first strain section and the second strain section extend substantially parallel to each other. These embodiments allow for a smooth bending of the stud. It is further possible to arrange the at least one first strain section and the second strain section perpendicular to each other. Thereby, the at least one first strain section is arranged perpendicular to the longitudinal axis and the second strain section is arranged parallel to the longitudinal axis. This configuration allows for a strain in longitudinal and transverse direction. The second strain section could also be arranged parallel to the shoe sole, i.e., horizontally in the stud, and allow for cushioning in axial direction (as known from the prior art). Also, a combination of all three strain sections is possible.

In some embodiments, the at least one first and the second strain section are connected to each other through at least one material ridge made of stretchable material. Such an embodiment allows simplified assembly (e.g., using molding techniques) and further affects the flexibility, since the stud comprises more stretchable, elastic material.

In other embodiments, the at least one first strain section and the second strain section are integrally formed. The at least one first strain section and the second strain section may be assembled in one step. A material ridge may connect the at least one first strain section and the second strain section to each other. When manufacturing the stud and the shoe sole, e.g. using injection molding techniques, a lower number of pieces may be advantageous.

According to additional embodiments, the present invention relates to a shoe sole comprising at least one stud for the shoe sole, wherein the at least one stud comprises at least a first stud portion a second stud portion, and at least one first strain section, which connects the first stud portion and the second stud portion to each other, wherein the at least one first strain section is configured to be strained when the stud is coupled to the shoe sole and the shoe sole is bent. Such a shoe sole offers improved bending properties compared with conventional shoe soles featuring rigid studs. This result is particularly present when one or more studs are arranged in the bending area of the shoe sole.

In other embodiments, the present invention relates to a studded shoe comprising a shoe sole comprising at least one stud for the shoe sole, wherein the at least one stud at least a first stud portion a second stud portion, and at least one first strain section, which connects the first stud portion and the second stud portion to each other, wherein the at least one first strain section is configured to be strained when the stud is coupled to the shoe sole and the shoe sole is bent. By using a shoe sole according to the present invention, studded shoes, in particular football shoes, are provided which have an improved flexibility in the bending area. Furthermore, at the same time, the studs also provide better traction.

According to additional embodiments, the present invention relates to a shoe sole comprising at least one stud for the shoe sole, wherein the at least one stud comprises a first stud portion, a second stud portion, a third stud portion, at least one first strain section, which connects the first stud portion and the second stud portion to each other, and a second strain section, which connects the second stud portion and the third stud portion to each other, wherein the at least one first strain section and the second strain section are configured to be strained when the at least one stud is coupled to the shoe sole and the shoe sole is bent. Such a shoe sole offers improved bending properties compared with conventional shoe soles featuring rigid studs. This result is particularly present when one or more studs are arranged in the bending area of the shoe sole.

In certain embodiments, the shoe sole further comprises at least one stud receiving device comprising at least one third strain section. The at least one third strain section is particularly desirable in the bending area of the shoe sole, if the rolling area extends transverse to the longitudinal direction of the shoe sole. Modern studs usually are not bolted to the shoe sole, but are instead coupled in custom-built stud receiving devices, e.g., by using a clip mechanism, bolting, magnetic mechanisms, other mechanisms, or even by permanently gluing, molding, or riveting. The stud receiving devices and/or studs may also be formed integrally together with the shoe sole. Such stud receiving devices already lead to a higher rigidity of the shoe sole and therefore may hinder a bending of the shoe sole. Accordingly, by adding another strain section to the stud receiving devices, the bending flexibility of the shoe sole can be further improved. This result holds true for both a stud that is releasably coupled to the stud receiving device, as well as a stud that is permanently coupled to the stud receiving device.

In other embodiments, the at least one third strain section extends beyond the at least one stud receiving device into the shoe sole. Since the bending of the foot extends over the full width of the shoe sole, a further extension of the at least one third strain section in a lateral direction beyond the stud receiving device is preferred, in order to optimally support rolling-off of the foot and exploit the mentioned advantages of the various embodiments. However, different attachments of at least one third strain section are possible, which may depend for instance on the rolling off behavior of the foot.

In other embodiments, the at least one first strain section and the at least one third strain section are integrally formed. Again, this integral formation allows for an easier production and assembly of the shoe sole.

In other embodiments, the shoe sole further comprises at least one fourth strain section, which is positioned in an area of the shoe sole without a stud. Attaching at least one fourth strain section in a transverse direction of the shoe sole may also improve the flexibility when bending the shoe sole in dorsal direction. Moreover, different attachments of the at least one fourth strain section are possible, e.g., in direction of a longitudinal axis of the shoe sole. Such a strain section in longitudinal direction is particularly helpful in the tip of the foot or the forefoot area, e.g., between the second and the third phalanges. This strain section enables an improved adaptation of the shoe to the ground and provides more stability.

In other embodiments, the at least one first strain section, the second strain section, the at least one third strain section, or the at least one fourth strain section is positioned in a bending area of the shoe sole. Typically, improved flexibility of the shoe sole is required in the bending area, e.g., in the area of the forefoot. Of course, it may also be advantageous to include strain sections at other positions of the shoe sole, as already mentioned above.

In certain embodiments, the shoe sole, the at least one stud, the first stud portion, the second stud portion, the third stud portion, the at least one first strain section, and the second strain section are integrally formed. Using modern production techniques (e.g. multiple component injection molding), it is possible to produce shoe soles from different materials. For example, a first material can be used for the various strain sections on the one hand and another material can be used for the other portions of the stud and/or the shoe sole on the other hand. This leads to a clearly reduced complexity of the production of the shoe sole. However, it is also possible to provide the above mentioned features within a stud and a shoe sole, which are releasably attached to each other such that the stud may be exchanged.

Finally, embodiments of the present invention relate to a studded shoe comprising a shoe sole comprising at least one stud for the shoe sole, wherein the at least one stud comprises a first stud portion, a second stud portion, a third stud portion, at least one first strain section, which connects the first stud portion and the second stud portion to each other, and a second strain section, which connects the second stud portion and the third stud portion to each other, wherein the at least one first strain section and the second strain section are configured to be strained when the at least one stud is coupled to the shoe sole and the shoe sole is bent. By using a shoe sole according to the present invention, studded shoes, in particular football shoes, are provided which have an improved flexibility in the bending area. Furthermore, at the same time, the studs also provide better traction.

DETAILED DESCRIPTION

Embodiments of the invention provide studs for use with a studded shoe. While the studs and studded shoes are discussed for use with sports shoes, they are by no means so limited. Rather, embodiments of the studs and studded shoes may be used in any type of shoe or otherwise as desired.

Figure 1:
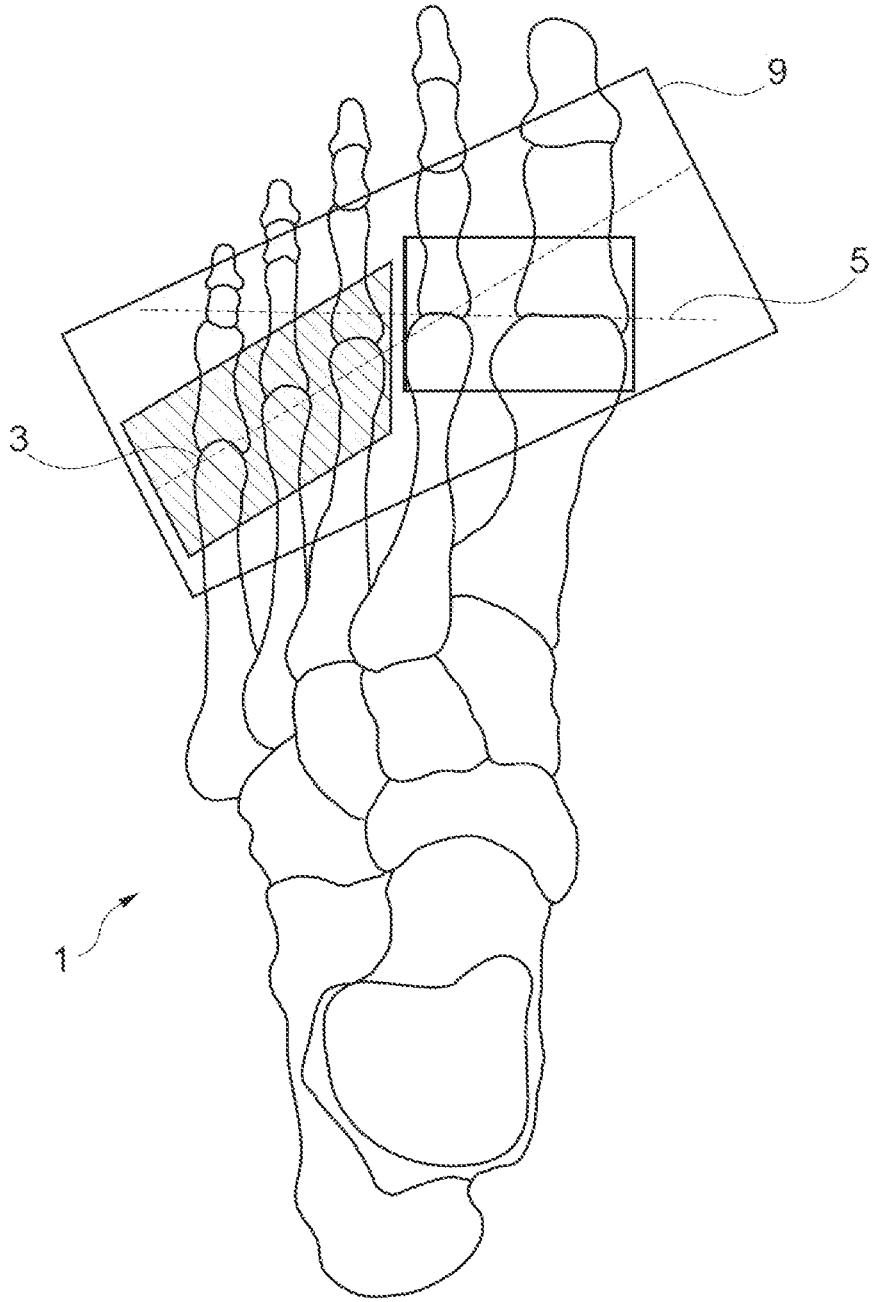
FIG. 1 is a schematic top view of a foot according to certain embodiments of the present invention.
Figure 2A:
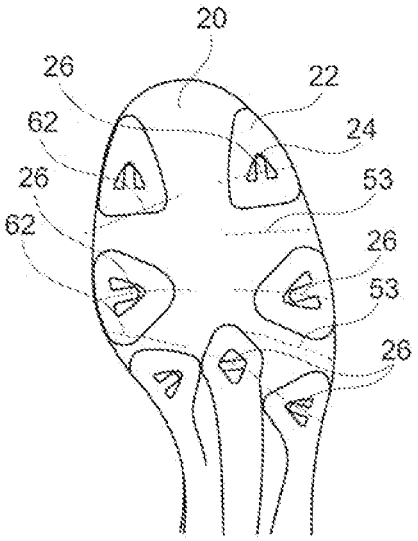
FIG. 2*a* is a schematic bottom view of a shoe sole according to certain embodiments of the present invention.
Figure 2B:
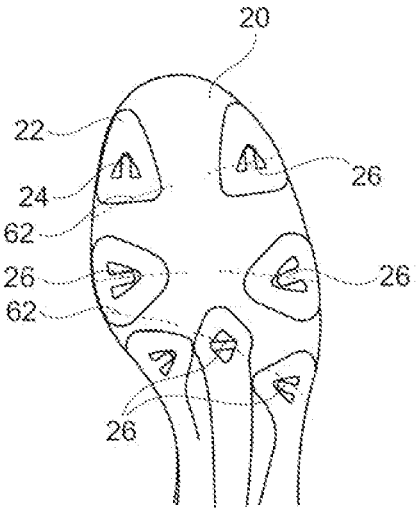
FIG. 2*b* is a schematic bottom view of a shoe sole according to alternative embodiments of the present invention.
Figure 2C:
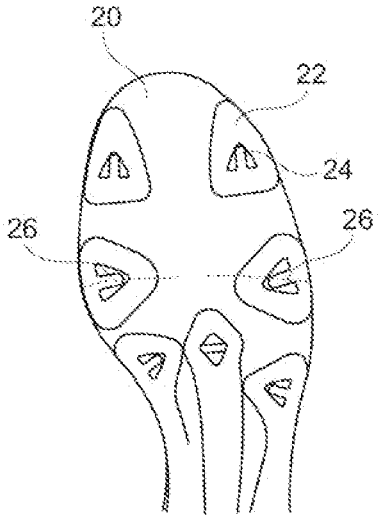
FIG. 2*c* is a schematic bottom view of a shoe sole according to other alternative embodiments of the present invention.
Figure 2D:
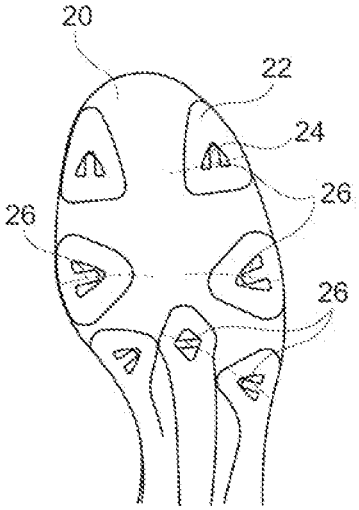
FIG. 2*d* is a schematic bottom view of a shoe sole according to yet other alternative embodiments of the present invention.

FIG. 1 shows a schematic drawing of a human foot 1. The phalanges define different bending areas of the foot; two lines have been highlighted with numbers 3 and 5. Line 3 shows a bending area that is defined by four phalanges and line 5 shows a bending area defined by two phalanges. When rolling-off of the foot, the toes are bent, and lines 3 and 5 show the bending areas. Overall, the bending area 9 extends over the full area of both lines 3 and 5.

FIGS. 2*a-d* and 3*a-b* illustrate a variety of possible embodiments of the design of shoe soles and studs comprising a strain section. In these embodiments, a shoe sole 20 is illustrated, which comprises a plurality of stud receiving devices 22 and studs 24. In some embodiments, at least one first strain section 26 may extend through at least one stud 24. In the embodiments shown in FIGS. 2*a-d*, 3*a-b*, 4*a-b*, and 5*a-b*, the first strain section 26 has substantially a shape of a strip. However, one of ordinary skill in the relevant art will understand that the first strain section 26 may be configured to have a shape that substantially corresponds to a strip, wedge, or other suitable shape. In these embodiments, some studs 24 may not include any first strain sections 26.

Figure 5A:
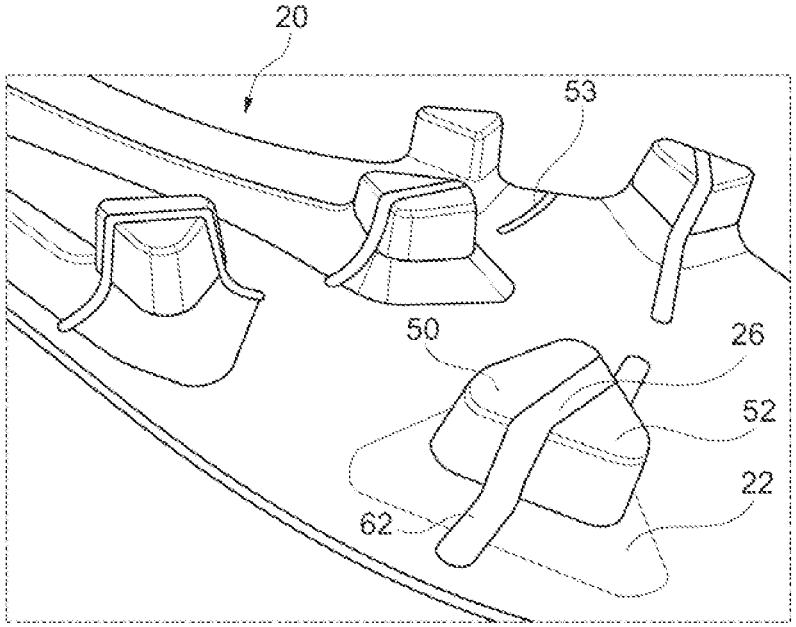
FIG. 5*a* is a partial bottom view of the shoe sole of FIG. 3*a*.
Figure 5B:
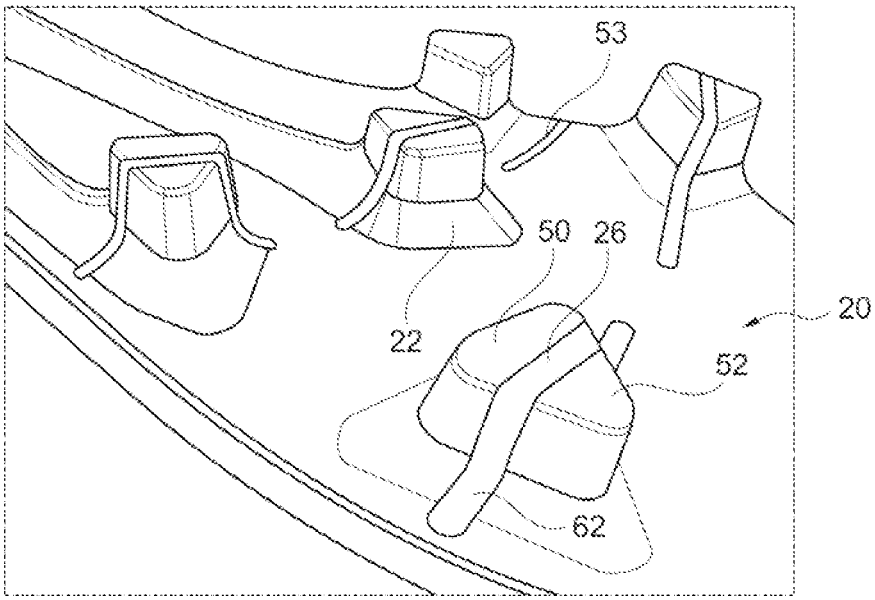
FIG. 5*b* is another partial bottom view of the shoe sole of FIG. 3*a*.

As shown in FIGS. 2*a-d*, 3*a-b*, 4*a-b*, and 5*a-b*, a single first strain section 26 may extend through the stud 24. In these embodiments, as illustrated in FIGS. 5*a-b*, the stud 24 may comprise a first stud portion 50 and a second stud portion 52, wherein the strain section 26 connects both stud portions 50, 52.

Figure 7A:
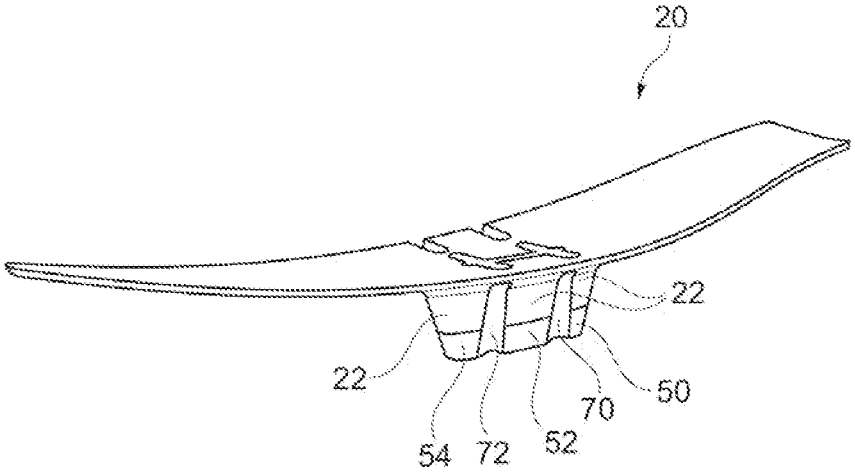
FIG. 7*a* is a side perspective view a shoe sole comprising studs and strain sections according to yet other alternative embodiments of the present invention.
Figure 7B:
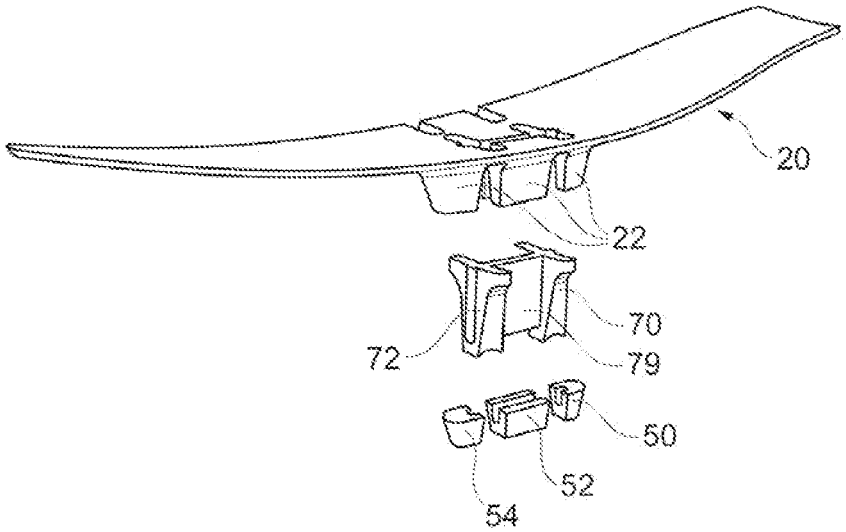
FIG. 7*b* is an exploded side perspective view of the single stud and the shoe sole of FIG. 7*a*.

In other embodiments, as shown in FIGS. 7*a-b*, two strain sections (a first strain section 70 and a second strain section 72) may extend through the stud 24. In these embodiments, the stud 24 may comprise the first stud portion 50, the second stud portion 52, and a third stud portion 54, wherein the strain sections 70, 72 connect the stud portions 50, 52, 54. In some instances, the use of multiple stud portions 50, 52, 54 to form the stud 24 can provide for easier manufacturing and assembly through a single production step.

In the embodiments shown in FIGS. 7*a-b*, the strain sections 70, 72 are wedge-shaped and are connected to one another via at least one material ridge 79. However, one of ordinary skill in the relevant art will understand that the strain sections 70, 72 may be configured to have a shape that substantially corresponds to a strip, wedge, or other suitable shape. In these embodiments, the material ridge 79 may, but not necessarily, be formed of a stretchable material. In some instances, the configuration of strain sections 70, 72, and material ridge 79 allows for an easier assembly of the strain sections 70, 72 through a single production step. The strain sections 70, 72 may be placed into the separately manufactured (e.g., using injection molding techniques) shoe sole 20 or the stud receiving device 22 and the stud 24, and subsequently attached thereto.

Figure 6A:
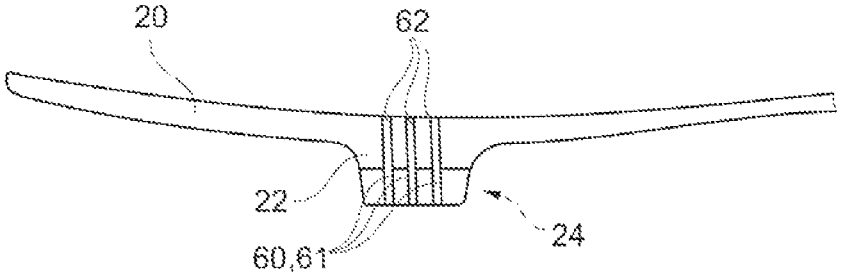
FIG. 6*a* is side view of a shoe sole comprising studs and strain sections according to yet other alternative embodiments of the present invention.
Figure 6B:
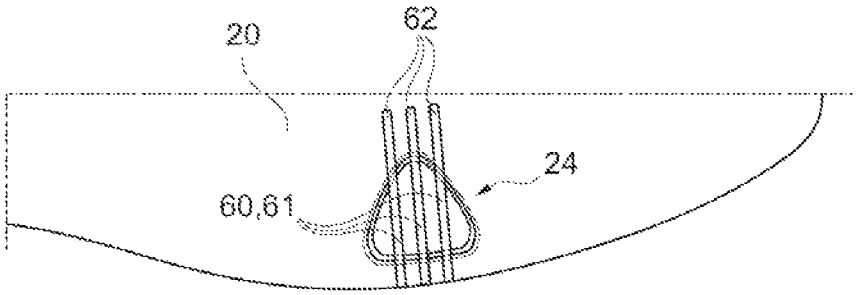
FIG. 6*b* is bottom view of the single stud and the shoe sole of FIG. 6*a*.

In yet other embodiments, as shown in FIGS. 6*a-b*, three strain sections (two first strain sections 60 and a second strain section 61) may extend through the stud 24. One of skill in the relevant art will understand that any suitable number of strain sections may extend through any suitable number of studs 24.

In some embodiments, as shown in FIGS. 3*a-b*, 4*a-b*, 5*a-b*, and 6*a-b*, at least one third strain section 62 may extend over at least one stud 24, through at least one stud receiving device 22, and/or beyond the stud receiving device 22 through at least part of the shoe sole 20. In some embodiments, some studs 24 and/or stud receiving devices 22 may not include any third strain sections 62.

In the embodiments shown in FIGS. 3*a-b*, 4*a-b*, and 5*a-b*, a single third strain section 62 may extend over the stud 24, through the stud receiving device 22, and/or beyond the stud receiving device 22. In these embodiments, the third strain section 62, which extends over the stud 24 itself, may be visible at each end of the first strain section 26. In the embodiments shown in FIGS. 3*a-b* and 4*a-b*, the third strain section 62 has substantially a shape of a strip. However, one of ordinary skill in the relevant art will understand that the third strain section 62 may be configured to have a shape that substantially corresponds to a strip, wedge, or other suitable shape In other embodiments, as shown in FIGS. 6*a-b*, three third strain sections 62 may extend over the stud 24, through the stud receiving device 22, and/or beyond the stud receiving device 22 through at least part the shoe sole 20. One of skill in the relevant art will understand that any suitable number of third strain sections 62 may extend through and/or beyond any suitable number of studs 24 and/or stud receiving devices 22.

As illustrated in FIGS. 6*a-b*, the first strain sections 60 and the second strain section 61 of the stud 24 and the third strain sections 62 of the stud receiving device 22 can be formed integrally. However, it is also possible to build the strain sections separately. The studs 24 may have the same or different numbers of strain sections. The number of strain sections in each stud 24 may depend on the position and the specific requirements.

The flexibility of each stud 24 may be adjusted to the expected movements based on the type and number of third strain sections 62 associated with each stud 24 and/or stud receiving device 22. In these embodiments, the studs 24 attached to the shoe sole 20 may have the same or different shapes.

In some embodiments, at least one fourth strain section 53 may extend through at least a portion of the bending area 9 (shown in FIG. 1) of the shoe sole 20, which does not include either studs 24 or stud receiving devices 22. As shown in FIGS. 2*a*, 3*a-b*, and 4*a*, two fourth strain sections 53 extend through areas of the shoe sole 20 that do not include studs 24 or stud receiving devices 22. One of ordinary skill in the relevant art will understand that any suitable number of fourth strain sections 53 may extend through any suitable number of areas of the shoe sole 20. In the embodiments shown in FIGS. 2*a*, 3*a-b*, 4*a*, and 5*a-b*, the fourth strain section 53 has substantially a shape of a strip. However, one of ordinary skill in the relevant art will understand that the fourth strain section 53 may be configured to have a shape that substantially corresponds to a strip, wedge, or other suitable shape.

Hence, the shoe sole 20 may comprise any suitable number of first (26, 60, 70), second (61, 72), third (62) and/or fourth (53) strain sections in any suitable location, including but not limited to extending through some or all of the studs 24, the stud receiving devices 22, and/or the shoe sole 20 itself.

In some embodiments, the first (26, 60, 70), second (61, 72), third (62) and/or fourth (53) strain sections may be adapted to the anatomy of the foot, in order to achieve optimal bending and flexibility. These strain sections may lead to a small strain in a dorsal movement of the foot and, therefore, to an improved and more flexible rolling-off of the foot. The strain sections can be arranged such that they generally extend perpendicular to a longitudinal axis of the shoe sole 20. Because of the anatomy of the foot (cf. FIG. 1), the strain sections may be arranged in different angles with respect to the longitudinal axis of the shoe sole 20, as illustrated in FIGS. 2*a-d*.

Figure 3A:
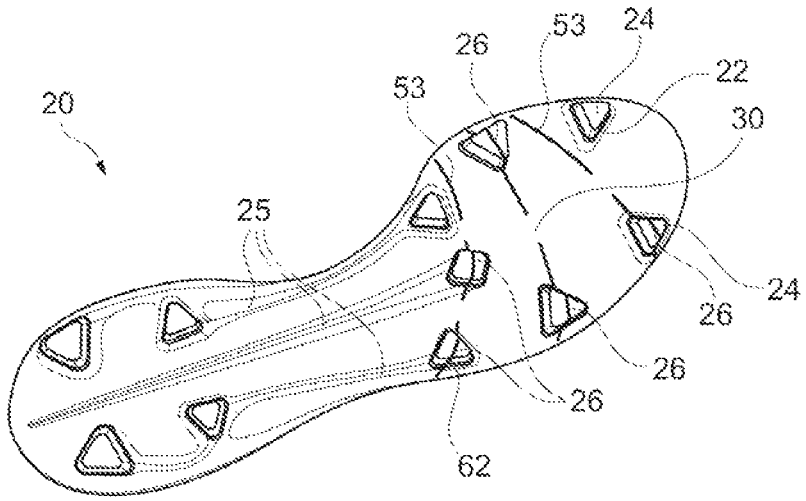
FIG. 3*a* is a bottom view of a shoe sole comprising studs and strain sections according to yet other alternative embodiments of the present invention.
Figure 3B:
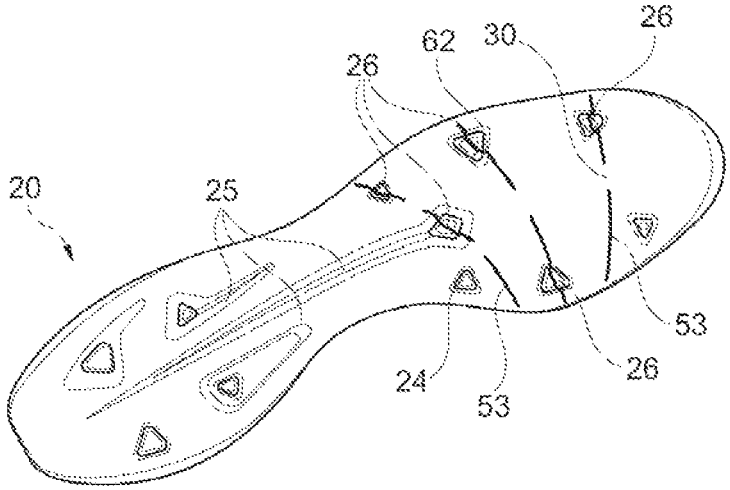
FIG. 3*b* is a top view of the shoe sole of FIG. 3*a*.
Figure 4A:
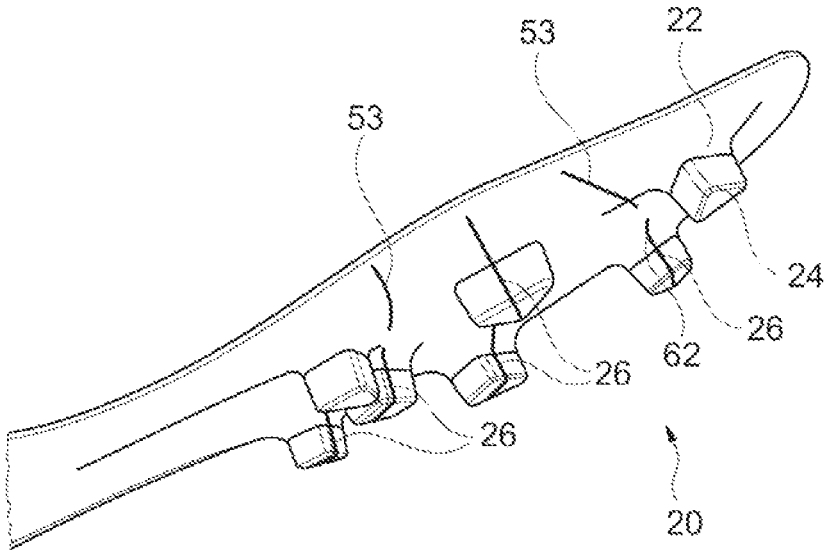
FIG. 4*a* is a side view of the shoe sole of FIG. 3*a*.
Figure 4B:
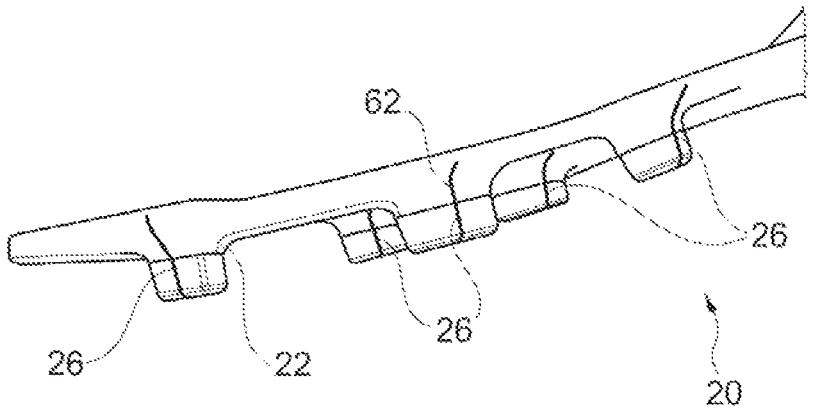
FIG. 4*b* is another side view of the shoe sole of FIG. 3*a*.

In these embodiments, the first (26, 60, 70), second (61, 72), third (62) and/or fourth (53) strain sections can be placed within the bending area 9 of the shoe sole 20, which is the area of the shoe sole 20 that primarily needs higher flexibility. FIGS. 3*a-b* illustrate embodiments having the fourth strain section 53 in the bending area 9 of the shoe sole 20, which does extend through a stud 24 or a stud receiving device 22. These strain sections are also adapted to the anatomy of the foot.

Figure 8A:
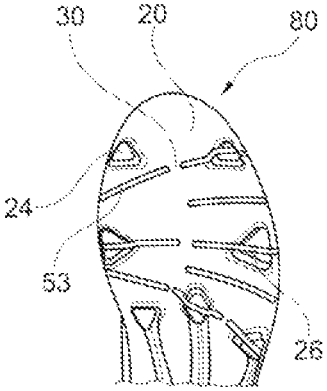
FIG. 8*a* is a bottom view of a shoe comprising studs and strain sections according to yet other alternative embodiments of the present invention.
Figure 8B:
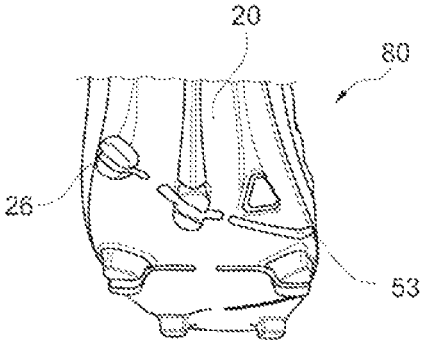
FIG. 8*b* is a bottom perspective view of the shoe of FIG. 8*a*.
Figure 8C:
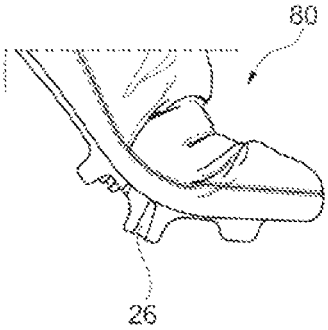
FIG. 8*c* is a side view of the shoe of FIG. 8*a* in a flexed position.
Figure 8D:
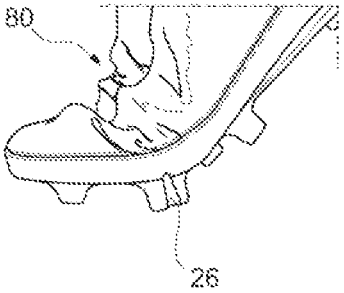
FIG. 8*d* is another side view of the shoe of FIG. 8*a* in a flexed position.

Embodiments, such as the embodiments shown in FIGS. 8*a-d*, include a studded shoe 80 with differently arranged strain sections 26, 53. In some embodiments, the strain sections 26 may, but not necessarily, extend beyond a stud 24 into the shoe sole 20, but not over the full width of the shoe sole 20. Depending on the respective use case, in other embodiments, strain sections 26, 53 extending over the full width may be advantageous. The strain sections 26, 53 are arranged according to the bending areas of the foot when moved in a dorsal direction, such as illustrated in FIGS. 8*c-d*, where the strain when rolling-off of the foot may be seen. By flexing the foot more, outer portions of the stud 24 experience a larger strain than portions that are nearer to the shoe sole 20, which is shown, for example, in FIGS. 8*c-d*. Due to the rolling off of the foot, the strain sections 26 are more strongly bent at the lower end, which may result in a wedge shape. However, the strain sections 26 shown in FIG. 8*a-b* could already be substantially strip- or wedge-shaped in a relaxed state.

In other embodiments, it is further possible that the strain of the strain section 26 may be restricted through a rigid piece of material, which could form a dead stop and thus restrict a strain. This piece of material could be stick-shaped and replaceable or retrofittably positioned in a drill hole of the stud 24. The drill hole should preferably be directed in a longitudinal direction of the shoe.

FIGS. 2*c-d*, 3*a-b*, and 5*a-b* illustrate that some of the studs 24 and/or the stud receiving devices 22 may not comprise a strain section 26, 62, which may be the case for studs 24 arranged in the heel area of the shoe sole 20 (not shown), but also in the area of the big toe. Such studs 24 may also be used for accelerating, in which case, strain sections 26, 53, 62 may not be necessary.

FIGS. 3*a*-3*b* illustrate an embodiment of the same shoe sole 20 from two perspectives. Thus, as can be seen from these figures, the strain sections 26, 53, 62 extend through the shoe sole 20, i.e., from an upper side to a lower side. In these embodiments, the strain sections 26, 53, 62 can be fan-shaped (three "strips") in order to fit the bending area 9 of the feet optimally. Since the medial bending radius is smaller than the lateral bending radius, the fan extends from the medial to the lateral side. In other words, the distance between the strips is larger at the lateral side compared to the medial side.

Some embodiments may include longitudinal grooves 25 for stabilizing the shoe sole 20 in longitudinal direction. Moreover, interruptions 30 ("stability breaks") between the first (26, 60, 70), second (61, 72), third (62) and/or fourth (53) strain sections may be included to increase the stability of the shoe sole 20.

In some embodiments, the shoe sole 20 is manufactured using an injection molding technique. The embodiments having an arrangement of the strain sections 26, 53, which do not extend over the full width of the shoe sole 20, but comprise interruptions 30, allow for a simplified manufacturing in a single step, e.g., using multiple component injection molding. By using the interruptions 30, no interruptions of the flow of material for the shoe sole 20 is necessary. Further, these embodiments show studs 24 without strain sections 26, 53 in the heel area and in the area of the big toe. Depending on the respective requirements, the strain sections 26, 53, 62 could also extend differently.

In some embodiments, the material, the placement, and/or the dimensions of the studs 24 or the first (26, 60, 70), second (61, 72), third (62) and/or fourth (53) strain sections may influence the flexibility and the construction of the respective strain sections. For example, perforations or other material weakening can allow a stretching of material and consequently create a strain section. A further possible construction comprises an embodiment similar to a bellow. In these embodiments, the bellow can be stretched under the influence of a force.

The shoe sole 20, the studs 24, the stud receiving devices 22, and/or the first (26, 60, 70), second (61, 72), third (62) or fourth (53) strain sections may be manufactured using two- or multiple component injection molding. In some exemplary embodiments, three components for the shoe sole 20, the stud receiving device 22, the strain sections 26, 53, 62, and the studs 24 are used. Possible components include but are not limited to thermoplastic elastomers (TPE, TPU), polyamides, Polyether Block Amids (PEBAs) of different hardness and elasticity, or other suitable materials. In order to avoid a feeling of instability, the respective components should not be too soft.

Moreover, the studs 24 and the first (26, 60, 70), second (61, 72), third (62) or fourth (53) strain sections may be manufactured from the same material such as TPE, TPU or PEBA, in respectively different mixtures yielding different material properties. Similar materials provide a particularly good composite. To increase the stability in areas outside the strain sections, fiber-reinforced composite materials can be used. Alternatively, one or more of the strain sections could be made in a first step, then positioned within a mold, and the shoe sole 20 and the stud 24 could be injected around these strain sections. Furthermore, all parts of the first (26, 60, 70), second (61, 72), third (62) and/or fourth (53) strain sections, the studs 24, and the shoe sole 20 could be manufactured separately in a first step and then assembled in a subsequent second step. Possible methods include but are not limited to gluing, laser welding, ultrasonic welding, releasable mechanic connections, or other suitable attachment methods.

Two exemplary production methods may be desirable in some embodiments. First, the studs may be made of TPU and positioned in a mold, and the material of the strain sections may be made in a second step. These steps may be performed separately or connectedly. The strain sections may then be inserted or directly injection molded. The stud areas and the strain sections are then injection molded with TPU or PA of the shoe sole. Another option may be to first build the stud areas, then the shoe sole, and finally insert the strain sections into the respective cavities.

The foregoing is provided for purposes of illustrating, explaining, and describing embodiments of the present invention. Further modifications and adaptations to these embodiments will be apparent to those skilled in the art. The features and aspects of the present invention have been described or depicted by way of example only and are therefore not intended to be interpreted as required or essential elements of the invention unless otherwise so stated. It should be understood, therefore, that the foregoing relates only to certain exemplary embodiments of the invention, and that numerous changes and additions may be made thereto without departing from the spirit and scope of the invention as defined by any appended claims.

That which is claimed is:

1. A stud for a shoe sole, comprising:

(a) at least one first strain section and at least one second strain section, each strain section comprising at least two connection surfaces and a contact surface, wherein each strain section extends through the stud and beyond the stud into the shoe sole so that the at least two connection surfaces of each strain section each form an angle of 45 degrees to 90 degrees with a surface of the shoe sole when the stud is coupled to the shoe sole;

(b) at least one first stud portion and at least one second stud portion, each connected to one of the at least two connection surfaces of the at least one first strain section;

(c) at least one third stud portion, wherein the at least one third stud portion and the at least one second stud portion are each connected to one of the at least two connection surfaces of the at least one second strain section;

(d) wherein each stud portion comprises a contact surface;

(e) wherein the at least one first strain section and the at least one second strain section are configured to be strained when the stud is coupled to the shoe sole and the shoe sole is bent;

(f) wherein the strain sections and the stud portions are shaped so that the contact surfaces of the strain sections and the stud portions are aligned at approximately the same height to form a stud contact surface, wherein the contact surfaces remain connected to each other when the shoe sole is bent.

2. The stud according to claim 1, wherein the at least one first stud portion and the at least one second stud portion are connected to each other only by the at least one first strain section.

3. The stud according to claim 1, wherein the at least one first stud portion, the at least one second stud portion, and the at least one first strain section are integrally formed.

4. The stud according to claim 1, wherein the at least one first strain section extends substantially perpendicular to a tangent plane proximate an area of the shoe sole where the stud is configured to be coupled to the shoe sole.

5. The stud according to claim 1, wherein the at least one first strain section has substantially a shape of a strip.

6. The stud according to claim 1, wherein the at least one first strain section is wedge-shaped.

7. The stud according to claim 1, wherein the at least one first strain section and the at least one second strain section extend substantially parallel to each other.

8. The stud according to claim 1, wherein the at least one first strain section and the at least one second strain section are connected to each other through at least one material ridge made of stretchable material.

9. The stud according to claim 1, wherein the at least one first strain section and the at least one second strain section are integrally formed.

10. A shoe sole comprising at least one stud according to claim 1.

11. A studded shoe comprising the shoe sole according to claim 10.

12. A shoe sole comprising at least one stud for the shoe sole, wherein the at least one stud comprises:

(a) at least one first strain section comprising at least two connection surfaces and a contact surface, wherein the at least one first strain section extends through the at least one stud and beyond the at least one stud into the shoe sole so that the at least two connection surfaces each form an angle of 45 degrees to 90 degrees with a surface of the shoe sole when the at least one stud is coupled to the shoe sole;

(b) a second strain section comprising at least two connection surfaces and a contact surface, wherein the second strain section extends through the at least one stud and beyond the at least one stud into the shoe sole so that the at least two connection surfaces each form an angle of 45 degrees to 90 degrees with the surface of the shoe sole when the at least one stud is coupled to the shoe sole;

(c) a first stud portion connected to a first one of the at least two connection surfaces of the at least one first strain section;

(d) a second stud portion connected to a second one of the at least two connection surfaces of the at least one first strain section and to a first one of the at least two connection surfaces of the second strain section;

(e) a third stud portion connected to a second one of the at least two connection surfaces of the second strain section;

wherein each stud portion comprises a contact surface;

(g) wherein the at least one first strain section and the second strain section are configured to be strained when the at least one stud is coupled to the shoe sole and the shoe sole is bent; and (h) wherein the at least one first strain section, the first stud portion, the second stud portion, the second strain section, and the third stud portion are shaped so that the contact surfaces are aligned at approximately the same height to form a stud contact surface, wherein the contact surfaces remain connected to each other when the shoe sole is bent.

13. The shoe sole according to claim 12, further comprising at least one stud receiving device comprising at least one third strain section.

14. The shoe sole according to claim 13, wherein the at least one third strain section extends beyond the at least one stud receiving device into the shoe sole.

15. The shoe sole according to claim 13, wherein the at least one first strain section and the at least one third strain section are integrally formed.

16. The shoe sole according to claim 13, wherein the shoe sole further comprises at least one fourth strain section, which is positioned in an area of the shoe sole without a stud.

17. The shoe sole according to claim 16, wherein the at least one first strain section, the second strain section, the at least one third strain section, and/or the at least one fourth strain section is positioned in a bending area of the shoe sole.

18. The shoe sole according to claim 12, wherein the shoe sole, the at least one stud, the first stud portion, the second stud portion, the third stud portion, the at least one first strain section, and the second strain section are integrally formed.

19. A studded shoe comprising the shoe sole according to claim 12.

* * * * *